US007622679B2

(12) United States Patent
Huang et al.

(10) Patent No.: US 7,622,679 B2
(45) Date of Patent: Nov. 24, 2009

(54) SIGNAL TRANSMISSION CABLE AND MULTI-WIRE CABLE

(75) Inventors: Detian Huang, Hitachi (JP); Hiroshi Komuro, Hitachi (JP); Ryuji Nakagawa, Nakagun (JP); Kazuyuki Naito, Hitachi (JP); Hiroshi Okikawa, Hitachi (JP)

(73) Assignees: Hitachi Global, Ltd., Tokyo (JP); Hitachi Cable Fine-Tech, Ltd., Hitachi-shi, Ibaraki (JP)

( * ) Notice: Subject to any disclaimer, the term of this patent is extended or adjusted under 35 U.S.C. 154(b) by 0 days.

(21) Appl. No.: 12/213,107

(22) Filed: Jun. 13, 2008

(65) Prior Publication Data

US 2008/0314613 A1 Dec. 25, 2008

(30) Foreign Application Priority Data

Jun. 15, 2007 (JP) ..... 2007-158691

(51) Int. Cl.
*H01B 7/18* (2006.01)

(52) U.S. Cl. ..... 174/107; 174/113 R

(58) Field of Classification Search ..... 174/113 R, 174/107, 102 SC, 117 F
See application file for complete search history.

(56) References Cited

U.S. PATENT DOCUMENTS

| | | | | |
|---|---|---|---|---|
| 2,468,664 | A * | 4/1949 | Hanford et al. | 526/221 |
| 7,417,187 | B2 * | 8/2008 | Tanaka et al. | 174/47 |
| 2003/0026995 | A1 * | 2/2003 | Duchesne et al. | 428/421 |
| 2005/0029006 | A1 * | 2/2005 | Takahashi et al. | 174/102 R |
| 2006/0052558 | A1 * | 3/2006 | Morikawa et al. | 526/247 |
| 2007/0068696 | A1 * | 3/2007 | Matsui et al. | 174/113 R |

* cited by examiner

*Primary Examiner*—Chau N Nguyen
(74) *Attorney, Agent, or Firm*—McGinn IP Law Group, PLLC

(57) ABSTRACT

An insulating layer 3 mainly composed of a fluorine resin is provided at an outer periphery of an inner conductor 2 to provide an inner insulated wire 4. A skin layer 5 mainly composed of a fluorine resin and doped with titanium oxide and carbon black or the titanium oxide and nickel as color pigment is provided at an outer periphery of stranded inner insulated wires 4. An outer conductor (shield) 6 is provided at an outer periphery of the skin layer 5, and a sheath layer (jacket) 7 is provided at an outer periphery of the outer conductor 6, to provide a signal transmission cable 1 having excellent electric characteristics, mechanical characteristics and terminal workability.

14 Claims, 5 Drawing Sheets

SIGNAL TRANSMISSION CABLE AND MULTI-WIRE CABLE

The present application is based on Japanese Patent Application No. 2007-158691 the entire contents of which are incorporated herein by reference.

BACKGROUND OF THE INVENTION

1. Field of the Invention

The present invention relates to a signal transmission cable and a multi-wire cable having excellent electric characteristics, mechanical characteristics, and terminal workability.

2. Related Art

As a cable used for signal transmission between a main body and a liquid-crystal display in small-sized electronic devices such as notebook-sized personal computer, portable telephone and the like, a superfine coaxial cable has been used, since predetermined electric characteristics for EMI (Electromagnetic Interference) and SKEW (a clock skew) are required. For example, Japanese Patent Laid-Open No. 2002-352640 (JP-A-2002-352640) discloses an example of the super fine coaxial cables.

As shown in FIG. 9, a superfine coaxial cable 91 comprises an inner conductor 92, an insulating layer 93 provided at an outer periphery of the inner conductor 92, an outer conductor 94 provided at an outer periphery of the insulating layer 93, and a sheath 95 provided at an outer periphery of the outer conductor 94.

A method of signal transmission between the main body and the liquid-crystal display in the notebook-sized personal computer is shifted from a parallel transmission method to a serial transmission method. Since strict electric characteristics are required in a cable for the serial transmission compared with those of the superfine coaxial cable, two-wire (core) coaxial cables, four-wire stranded common shield cables are used. For example, Japanese Patent Laid-Open No. 2003-22718 (JP-A-2003-22718) discloses an example of the two-wire coaxial cables. Japanese Patent Laid-Open No. 2003-132743 (JP-A-2003-132743) and a Japanese publication No. 9-511359 of translation of WO96/24143 (JP-T-9-511359) disclose examples of the four-wire stranded common shield cables.

As shown in FIG. 10, a two-wire coaxial cable 101 comprises two inner insulated wires 104 each having an inner conductor 102 and an insulating layer 103 provided at an outer periphery of the inner conductor 102, an outer conductor 105 provided at outer periphery of the inner insulated wires 104, and a sheath 106 provided at an outer periphery of the outer conductor 105.

As shown in FIG. 11, a four-wire stranded common shield cable 111 comprises four inner insulated wires 114 each having an inner conductor 112 and an insulating layer 113 provided at an outer periphery of the inner conductor 112, the inner insulated wires 114 being stranded around an outer periphery of a filler 115, an outer conductor 116 provided at outer periphery of the inner insulated wires 114, and a sheath 117 provided at an outer periphery of the outer conductor 116.

The number of the portable telephones using the two-wire coaxial cable is increased. As for the two-wire coaxial cable, bending resistance property (flexibility) and twisting resistance property are highly requested, and the number of internal antennas for increasing various receiving functions is increased, so that high EMI characteristics are requested.

These cables are used in a manner that a plurality of cables are arranged in parallel, and a terminal portion of the cable is made flat and connected onto a board at a connector side. This terminal work (processing) is conducted by laser beam machining with use of YAG laser, however, it is necessary for preventing the inner conductor from being damaged by the irradiation of the laser beam.

As a technique of directly cutting the outer conductor by the laser beam machining without damaging the inner conductor, Japanese Patent Laid-Open No. 2005-251522 (JP-A-2005-251522) proposes a technique of coloring a fluorine resin which is a main material of the insulating layer covering the inner conductor into "pale black" by doping 0.025 wt % to 0.14 wt % of carbon black.

As a technique of composing a cable in which the outer conductor can be cut without damaging the inner conductor, Japanese Patent Laid-Open No. 2004-192815 (JP-A-2004-192815) proposes a technique of doping powdery additives to the resin which is the main material of the insulating layer covering the inner conductor. The powdery additive is made by mixing an additive with white color or metallic color which easily provides a total reflection of the laser beam, an additive with black color which easily absorbs the laser beam, and a colorant made of a metallic oxide.

These cables are also called as differential signal transmission cable, since a differential signal is transmitted between the main body and the liquid-crystal display.

However, there are following disadvantages in structure of the conventional cable.

Since the two-wire coaxial cable 101 shown in FIG. 10 has an elliptical cross section, a symmetrical property at 360° around the two-wire coaxial cable 101 is not good, so that it is not suitable for the application of twisting the cable multi-axially, for example, in the portable telephone.

In the four-wire stranded common shield cable 111 shown in FIG. 11, a pitch between the inner insulated wires 114 is easily varied when the cable is bent or twisted, so that the electric characteristics are instable, and variation in the electric characteristics is large. In addition, when the terminal processing for arranging the inner insulated wires 114 in a pitch of 0.3 mm to 0.5 mm, there are many failures in that tip portions of strands (bare wires) wound around the inner insulated wires 114, which constitute the outer conductor 116, stick into the insulating layer 113 of the inner insulated wire 114, so that the strands are short-circuited with the inner conductors 112.

In the four-wire stranded common shield cable 111, when wrapping a copper-evaporated PET tape over an outer periphery of stranded four inner insulated wires 114 to provide the outer conductor 116, the cable has a high hardness and the mechanical characteristics such as the flexibility, the twist-resistance property are not good while the electric characteristics are stable. Therefore, the four-wire stranded common shield is not suitable for the application of twisting the cable multi-axially, for example, in the portable telephone.

Further, in the conventional cable, there is a problem of the terminal processing, in that it is difficult to conduct the laser beam machining with the use of YAG laser. Namely, the laser beam transmits through gaps between the strands in the outer conductor, thereby damaging the insulating layer of the inner insulated wires as well as the inner conductor.

As for the superfine coaxial cable 91 shown in FIG. 9 (disclosed by JP-A-2002-352640), in the case that a thickness of the insulating layer 93 is relatively large, e.g. 60 μm, the insulation characteristic is high, namely, an acceptance rate of the insulation resistance test reaches 100%. On the other hand, in the case that the thickness of the insulating layer 93 is relatively small, e.g. 40 μm, 50 μm, namely, less than 60 μm, the insulation characteristic is low. Therefore, when the carbon black is added to the insulating layer 93, it is necessary to increase the thickness of the insulating layer 93 to maintain the high insulation characteristic. As a result, the diameter of the cable is increased.

Still further, as for the cable comprising a plurality of the inner insulated wires as shown FIGS. 10 and 11, when the color of the insulating layer is totally colored by black, it is difficult to discriminate the inner insulated wires by visual inspection. On the other hand, when a color other than black is used for the insulating layer, for example, when only one of the insulating layers is colored by black and the other insulating layers are colored by different colors that are distinguishable from black, the insulating layer and the inner conductor of the inner insulated wire having the insulating layer colored by the color other than black will be damaged when the outer conductor is cut by the laser beam machining. The reason why the insulating layer and the inner conductor of the inner insulated wire are not damaged when the color of the insulating layer is black is not perfectly elucidated yet. However, the Inventors contemplated that the black insulating layer is doped with the carbon black as a color pigment and an optical transmission rate of the carbon black is remarkably small compared with other color pigments, so that the carbon black has an effect of suppressing the damage of the inner conductor by intercepting the light. In addition, the Inventors contemplated that although the carbon black generates the heat by radiation of the laser beam since the carbon black has a characteristic of absorbing more light than the other color pigments, a temperature of the generated heat in the carbon black is lower than a softening temperature of the fluorine resin (about 302° C.), so that the fluorine resin will not be molten by the generated heat.

The cable disclosed by JP-A-2004-192815 is not practical, since kind of additives to be added to the resin which is the main material of the insulating layer, combination thereof, and doping amount thereof are not disclosed.

SUMMARY OF THE INVENTION

Accordingly, an object of the present invention is to solve the above problem and to provide a signal transmission and a multi-wire cable having excellent electric characteristics, mechanical characteristics, and terminal workability.

According to a feature of the invention, a signal transmission cable comprises:

a plurality of inner insulated wires stranded with each other, each of the inner insulated wires comprising:

an inner conductor;

an insulating layer mainly composed of a fluorine resin provided at an outer periphery of the inner conductor;

a skin layer mainly composed of a fluorine resin and doped with a titanium oxide and a carbon black as color pigment and provided at an outer periphery of the stranded inner insulated wires;

an outer conductor provided at an outer periphery of the skin layer; and a sheath layer comprising an insulator and provided at an outer periphery of the outer conductor.

According to another feature of the invention, a signal transmission cable comprises:

a plurality of inner insulated wires stranded with each other, each of the inner insulated wires comprising:

an inner conductor;

an insulating layer mainly composed of a fluorine resin provided at an outer periphery of the inner conductor;

a skin layer mainly composed of a fluorine resin and doped with a titanium oxide and a nickel as color pigment and provided at an outer periphery of the stranded inner insulated wires;

an outer conductor provided at an outer periphery of the skin layer; and a sheath layer comprising an insulator and provided at an outer periphery of the outer conductor.

In the signal transmission cable, the skin layer may comprise 0.09 wt % to 0.46 wt % of the carbon black and 0.33 wt % to 1.62 wt % of the titanium oxide.

In the signal transmission cable, the skin layer may comprise 0.42 wt % to 1.52 wt % of the titanium oxide and 0.27 wt % to 0.85 wt % of the nickel.

In the signal transmission cable, respective insulating layers of the inner insulated wires may comprise insulating materials having colors different from each other.

In the signal transmission cable, a thickness of the insulating layer may be less than 40 μm.

In the signal transmission cable, 2, the skin layer may be formed by extrusion molding or wrapping.

In the signal transmission cable, the outer conductor may comprise a silver plated hard-drawn copper wire, a tin plated hard-drawn copper wire, a wound silver plated copper alloy wire, a wound tin plated copper alloy wire, or a braided silver plating copper alloy wire.

According to a further feature of the invention, a multi-wire cable comprises a plurality of the signal transmission cables that are flatly arranged.

According to a still further feature of the invention, a multi-wire cable comprises a plurality of the signal transmission cables that are stranded with each other.

EFFECTS OF THE INVENTION

The present invention provides following excellent effects.

(1) The signal transmission cable and the multi-wire cable according to the present invention have the excellent electric characteristics and mechanical characteristics.

(2) The signal transmission cable and the multi-wire cable according to the present invention are suitable for laser beam machining.

BRIEF DESCRIPTION OF THE DRAWINGS

Next, preferred embodiments according to the present invention will be explained in conjunction with appended drawings, wherein.

DETAILED DESCRIPTION OF PREFERRED EMBODIMENTS

Next, the preferred embodiments according to the present invention will be explained in more detail in conjunction with the appended drawings.

First Preferred Embodiment

Figure 1:
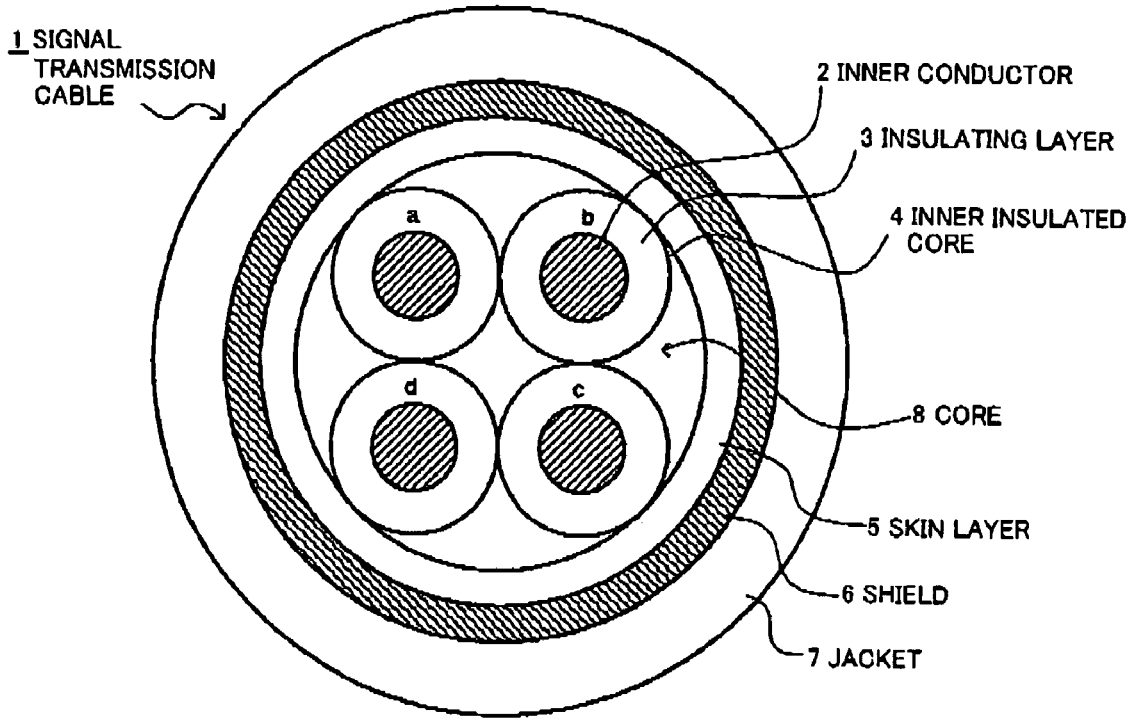
FIG. 1 is a cross-sectional view of a signal transmission cable in a first preferred embodiment according to the present invention.

As shown in FIG. 1, the signal transmission cable 1 in the first preferred embodiment according to the present invention comprises stranded four inner insulated wires 4, each of the inner insulated wires 4 comprising an inner conductor 2, an insulating layer 3 mainly composed of a fluorine resin provided at an outer periphery of the inner conductor 2, a skin layer 5 mainly composed of a fluorine resin and doped with two kinds of additives as color pigment and provided at an outer periphery of the stranded four inner insulated wires 4, an outer conductor (shield) 6 provided at an outer periphery of the skin layer 5, and a sheath layer (jacket) 7 comprising an insulator and provided at an outer periphery of the outer conductor 6.

Preferably, the inner conductor 2 of the inner insulated wire 4 is formed by stranding a plurality of copper alloy wires or silver-plated copper alloy wires. With considering that the signal transmission cable 1 is put through a hinge part of a notebook-sized personal computer or a portable telephone, a size of the inner conductor 2 is preferably 40AWG (American Wire Gauge) (7/0.028-0.032, namely, 7-stranded conductors each having a diameter of 0.028 mm to 0.032 mm) to 44AWG (7/0.014-0.018, namely, 7-stranded conductors each having a diameter of 0.014 mm to 0.018 mm).

It is preferable that the insulating layer 3 of the inner insulated wire 4 is made of a material which can be extruded to have a thin wall. The insulating layer 3 is preferably made of a material having a stable dielectric constant and a stable dielectric tangent at a frequency not more than 6 GHz particularly at a bandwidth from 800 MHz to 1.9 GHz. As the fluorine resin, it is preferable to use PFA (perfluoroalkoxy).

The insulating layer 3 of the inner insulated wire 4 has a thickness less than 40 μm.

The four inner insulated wires 4 are different in colors from each other, since the respective insulating layers 3 of the respective the inner insulated wires 4 comprise insulating materials having different colors.

As for stranding of the four inner insulated wires 4 to provide the four-wire core 8, it is preferable that a stranding pitch is 30-40 times of an overall outer diameter of the inner insulated wires 4 after stranding. It is preferable that a stranding direction is same as a stranding direction of the inner conductor 2.

The skin layer 5 is mainly composed of the fluorine resin and doped with two kinds of additives as the color pigments. Following additives may be used.

The titanium oxide mainly functions as an optical reflection agent with respect to a light wavelength (1064 nm) for cutting the outer conductor comprising the copper. The carbon black and the nickel mainly function as light absorption agents with respect to the light wavelength (1064 nm) for cutting the outer conductor comprising of the copper.

The skin layer 5 may comprise 0.09 wt % to 0.46 wt % of the carbon black and 0.33 wt % to 1.62 wt % of the titanium oxide for the fluorine resin that is the main material. For this case, the color of the skin layer 5 is gray.

The skin layer 5 may comprise 0.42 wt % to 1.52 wt % of the titanium oxide and 0.27 wt % to 0.85 wt % of the nickel for the fluorine resin that is the main material. For this case, the color of the skin layer 5 is gray.

The skin layer 5 is formed by extrusion molding or wrapping.

In the extrusion molding process, it is preferable that the skin layer 5 covers an overall outer periphery of the core 8. It is preferable that the skin layer 5 is made of a material which can be extruded to have a thin wall thickness. It is preferable that the skin layer 5 is made of a material having excellent elasticity resistance property and flexibility, in which a dielectric constant and a dielectric tangent are stable at a frequency not more than 6 GHz, particularly at a bandwidth from 800 MHz to 1.9 GHz. As the fluorine resins, it is preferable to use the PFA.

At this time, when the outer conductor 6 comprises plural stands, a thickness of the skin layer 5 is preferably 0.5 to 1.0 times of a strand diameter of the outer conductor 6.

In the wrapping process, the skin layer 5 is formed by wrapping a fluorine resin tape. At this time, it is preferable that the fluorine resin tape is butt-wound such that the fluorine resin tape is not overlapped partially.

It is preferable that the outer conductor 6 comprises a silver plated hard-drawn copper wire, a tin plated hard-drawn copper wire, a wound silver plated copper alloy wire, a wound tin plated copper alloy wire, or a braided silver plating copper alloy wire. As necessary, winding and braiding may be multiplied such as double.

It is preferable that the sheath layer 7 comprises a material that has a thin wall thickness and is strong for repeated bending. For example, the sheath layer 7 may comprise the fluorine resin such as PFA.

With considering that the signal transmission cable 1 is put through the narrow hinge part of the notebook-sized personal computer or the portable telephone and repeatedly twisted, an outer diameter of the signal transmission cable 1 is preferably not more than 0.7 mm.

According to the above structure, the electric characteristics of the signal transmission cable 1 are stable, even when the signal transmission cable 1 is bent or twisted, since the four inner insulated wires 4 composing the core 8 keep a constant spacing in the skin layer 5. In particular, the characteristic impedance is stable, so that good results can be obtained in the eye pattern test and the cross talk test.

In the signal transmission cable 1, since the mechanical characteristic of the four inner insulated wires 4 is reinforced by means of the skin layer 5, a bending life time (flexibility) is remarkably improved.

In the signal transmission cable 1, since the strand diameter of the core 8 is small, a twisting life time (twisting resistance characteristic) is improved.

In the signal transmission cable 1, since the core 8 is protected by the skin layer 5, the twisting life time is not shortened even if the outer conductor 6 of the signal transmission cable 1 is formed by winding the strands.

In the signal transmission cable 1, the wound strands composing the outer conductor 6 do not stick into the insulating layer when the terminal work for arranging the inner insulated wires 4 with a pitch of 0.3 mm to 0.5 mm is conducted.

In the signal transmission cable 1, the skin layer 5 comprises 0.09 wt % to 0.46 wt % of the carbon black and 0.33 wt % to 1.62 wt % of the titanium oxide for the fluorine resin that is the main material. Alternatively, the skin layer 5 comprises 0.42 wt % to 1.52 wt % of the titanium oxide and 0.27 wt % to 0.85 wt % of the nickel for the fluorine resin that is the main material. Therefore, there is no problem in simultaneous cutting of the outer conductor 6 and the skin layer 5 by using the laser beam, and it is easy to mold the skin layer 5.

In other words, when the titanium oxide is solely doped to the fluorine resin, it is advantageous in the simultaneous cutting of the outer conductor 6 and the skin layer 5 by using the laser beam, since the titanium oxide has a characteristic of easily reflecting the light compared with the other color pigments, and it is possible to melt the insulator at the outer periphery by reflecting the laser beam. On the other hand, the titanium oxide also has a characteristic of easily transmitting the light, so that damages to the inner insulator and the inner conductor are large.

Therefore, in the present invention, by using the carbon black having the characteristic of easily absorbing and hardly transmitting the light at the wavelength of 1064 nm of the laser beam for cutting the outer conductor (Cu) together with the titanium oxide, it is possible to simultaneously cutting the outer conductor and the skin layer by the laser beam and to prevent the inner insulator and the inner conductor from being damaged.

In addition, the Inventors found that it is possible to simultaneously cutting the outer conductor and the skin layer by the laser beam and to prevent the inner insulator and the inner conductor from being damaged, similarly to the case of using the carbon black, by selecting the nickel having the characteristic of easily absorbing the light at the wavelength of 1064 nm for cutting the outer conductor (Cu) as the second additive for the titanium oxide and blending the titanium oxide and the nickel at a predetermined ratio.

Further, since the signal transmission cable 1 comprises the skin layer 5, which prevents the laser beam from reaching the inner insulated wires 4, it is possible to provide the respective inner insulated wires 4 with various colors other than the black. It is possible to facilitate discrimination by visual inspection, by differentiating the colors of the respective inner insulated wires 4 from each other.

As described above, the signal transmission cable 1 is excellent in the terminal workability as well as the electric characteristics and the mechanical characteristic.

A plurality of signal transmission cables 1 may be combined with each other to provide a multi-wire cable.

Second Preferred Embodiment

Figure 2:
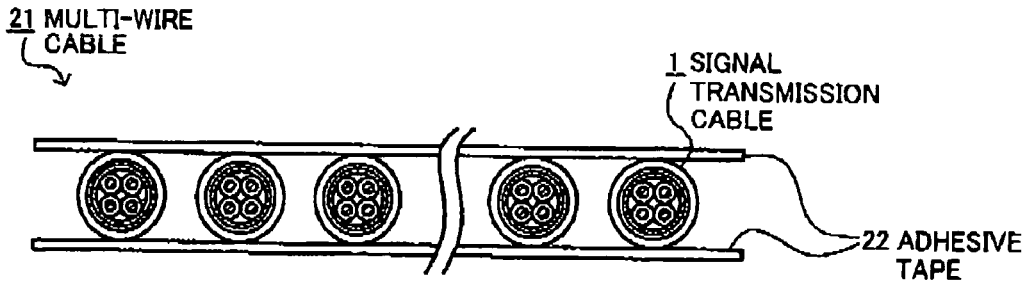
FIG. 2 is a cross-sectional view of a multi-wire cable in a second preferred embodiment according to the present invention.

As shown in FIG. 2, a multi-wire cable 21 in the second preferred embodiment according to the present invention comprises a plurality of the signal transmission cables 1 that are flatly arranged. In the multi-wire cable 21, the signal transmission cables 1 are disposed with a predetermined pitch on an adhesive tape 22 and another adhesive tape 22 is disposed on the signal transmission cables 1, to be integrated.

$CO_2$ laser beam is irradiated at a predetermined position of a sheath layer 7 at a terminal portion of this multi-wire cable 21 to make a notch, and removing a part of the sheath layer 7 at a cut terminal side, to expose a part of the outer conductor 6. YAG laser beam (1064 nm) is irradiated at a predetermined position of an exposed part of the outer conductor 6 to make a notch, and removing a part of the outer conductor 6 and a part of the skin layer 5 at the cut terminal side, to expose a part of the inner insulator 3. The $CO_2$ laser beam is irradiated at a predetermined position of an exposed part of the inner insulator 3 to make a notch, and removing a part of the inner insulator 3 at the cut terminal side, to expose a part of the inner conductor 2. Thereafter, the inner conductor 2 is connected to a terminal portion of a corresponding part (a wiring board) to be connected with the inner conductor 2, and the outer conductor 6 is connected to the ground, so that the terminal work is finished. As described above, according to the multi-wire cable 21 in which plural signal transmission cables are flatly arranged, it is possible to remove the outer conductor 6 and the skin layer 5 by irradiating the YAG laser beam only once to all the signal electrical transmission cables 1.

Third Preferred Embodiment

Figure 3:
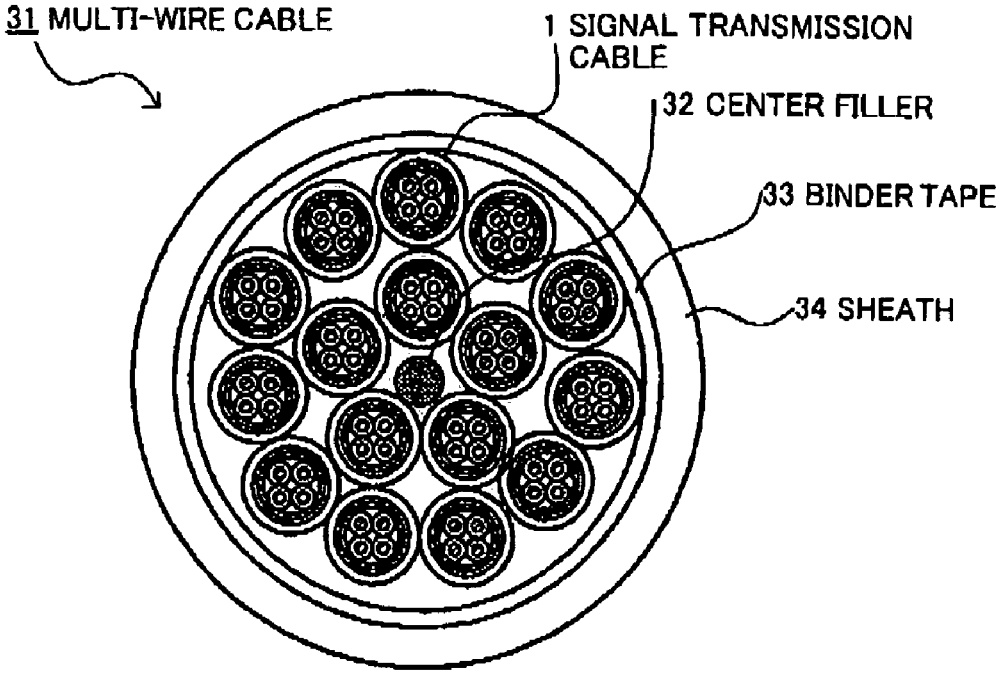
FIG. 3 is a cross-sectional view of a multi-wire cable in a third preferred embodiment according to the present invention.

As shown in FIG. 3, a multi-wire cable 31 in the third preferred embodiment according to the present invention comprises a plurality of the signal transmission cables 1 that are stranded with each other. In the multi-wire cable 31, a plurality (16, for example) of the signal transmission cables 1 are stranded with each other at an outer periphery of a tension member or center filler 16, a binder tape 33 is provided at an outer periphery of the stranded signal transmission cables 1, and a sheath 34 is provide at an outer periphery of the binder tape 33.

In the multi-wire cables 21, 31, the signal transmission cable 1 incorporated therein is excellent in the electric characteristics and the mechanical characteristics and is suitable for the laser beam machining, so that the multi-wire cables 21, 31 are suitable for signal transmission between the main body and the liquid-crystal display in the small size electronic equipment such as the notebook-sized personal computer, the portable telephone.

Examples

Figure 11:
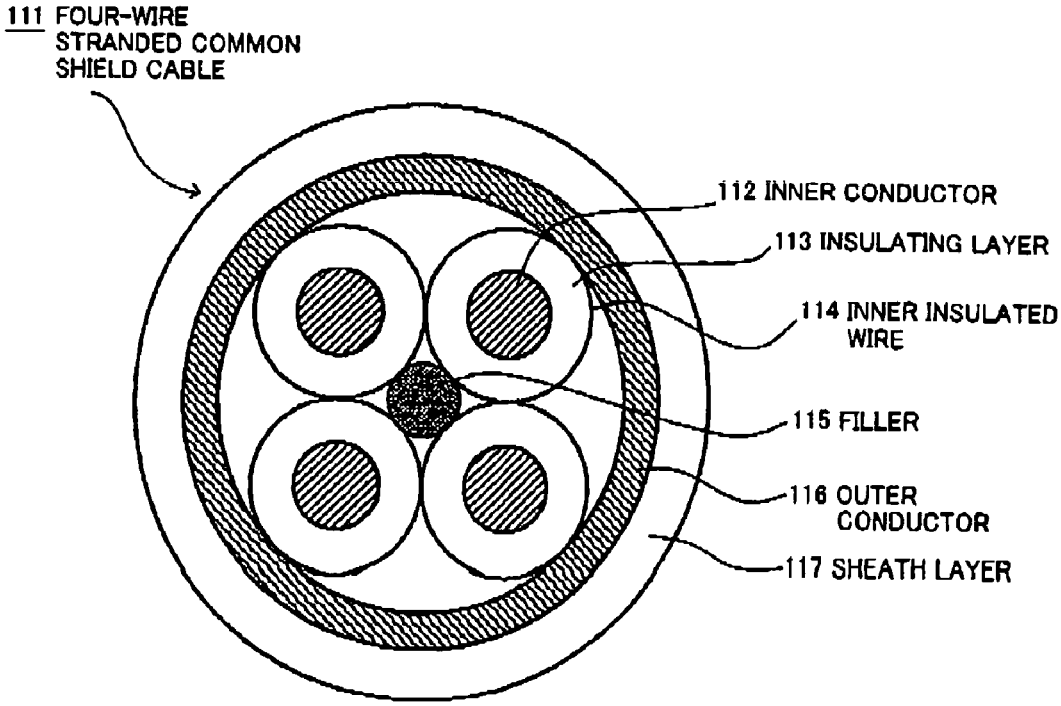
FIG.11 PRIOR ART
FIG. 11 is a cross-sectional view of a conventional four-wire stranded common shield cable.

For evaluating the electric characteristics and the mechanical characteristics, samples of the signal transmission cable 1 in the first preferred embodiment according to the present invention shown in FIG. 1 and samples of the conventional signal transmission cable shown in FIG. 11 were manufactured under manufacturing conditions shown in TABLE 1. The manufactured samples of the signal transmission cable 1 in the first preferred embodiment according to the present invention are referred as Examples #1, #2, and the manufactured samples of the conventional signal transmission cable are referred as Conventional examples #1, #2.

TABLE 1

| Samples | | Unit | Conventional Example #1 | Conventional Example #2 | Example #1 | Example #2 |
|---|---|---|---|---|---|---|
| Inner Conductor | Structure | Strand number/mm | 7/0.025 | 7/0.02 | 7/0.025 | 7/0.02 |
| | Material | — | Silver plated copper alloy | | | |
| Insulating | Structure | — | PFA | | | |

TABLE 1-continued

| Samples | | Unit | Conventional Example #1 | Conventional Example #2 | Example #1 | Example #2 |
|---|---|---|---|---|---|---|
| Layer | Wall Thickness | mm | 0.04 | 0.03 | 0.03 | 0.02 |
| Core | Outer Diameter | mm | 0.38 | 0.29 | 0.34 | 0.26 |
| Skin Layer | Layer Thickness | mm | None | | 0.02 | 0.015 |
| Outer Conductor | Structure | — | Winding | | | |
| | Material | — | Tin plated copper alloy | | | |
| | Strand Diameter | mm | 0.03 | | | |
| Sheath Layer | Material | — | Fluorine resin | | | |
| | Thickness | mm | 0.05 | | | |
| | Outer Diameter | mm | 0.54 | 0.45 | 0.54 | 0.45 |

As shown in TABLE 1, in the Example #1 and the Conventional Example #1, 44AWG (7/0.025) is used as the inner conductor 2, and the outer diameter of the sheath layer 7 is 0.54 mm. In the Example #2 and the Conventional Example #2, 44AWG (7/0.02) is used as the inner conductor 2, and the outer diameter of the sheath layer 7 is 0.45 mm. The difference between the Examples and the Conventional examples is presence of the skin layer 5.

The samples of the cables in the Examples and the Conventional examples are tested by following examination methods, and examination results of the electric characteristics and the mechanical characteristics as shown in TABLE 2 were evaluated.

TABLE 2

| Items | | | Unit | Conventional Example #1 | Conventional Example #2 | Example #1 | Example #2 |
|---|---|---|---|---|---|---|---|
| Mechanical Characteristics | | Bending Characteristic | Times | 10.200 | 14.500 | 14.700 | 19.200 |
| | | Twisting Characteristic | Times | 121,300 | 193,200 | 185,300 | 278,500 |
| Electric Characteristics | Characteristic Impedance | Straight | Ω | 112 | 112 | 113 | 113 |
| | | Bent | | 115.3 | 115.9 | 113.6 | 113.7 |
| | | Difference | | 3.3 | 3.9 | 0.6 | 0.7 |
| | Eye pattern Eye height (jitter) | 50 Mbps | mV(ps) | 864(180) | 630(260) | 874(160) | 640(228) |
| | | 100 Mbps | | 840(200) | 586(282) | 850(180) | 596(256) |
| | | 300 Mbps | | 712(240) | 498(342) | 776(190) | 528(275) |
| | | 640 Mbps | | 400(400) | 280(568) | 576(240) | 375(342) |
| | | 1000 Mbps | | 128(545) | 90(779) | 352(328) | 246(471) |
| | Differential noise crosstalk Eye height (jitter) | 50 Mbps | mV(ps) | 856(180) | 624(260) | 864(160) | 633(228) |
| | | 100 Mbps | | 832(200) | 582(280) | 839(180) | 588(256) |
| | | 300 Mbps | | 712(240) | 494(242) | 768(190) | 522(275) |
| | | 640 Mbps | | 384(400) | 278(567) | 568(245) | 370(345) |
| | | 1000 Mbps | | 112(542) | 78(775) | 344(328) | 239(471) |
| | Single noise Crosstalk Eye height (jitter) | 50 Mbps | mV(ps) | 856(180) | 624(260) | 856(160) | 623(228) |
| | | 100 Mbps | | 824(200) | 578(280) | 824(180) | 578(256) |
| | | 300 Mbps | | 704(240) | 487(242) | 760(190) | 518(275) |
| | | 640 Mbps | | 384(400) | 278(566) | 576(240) | 372(341) |
| | | 1000 Mbps | | 104(578) | 71(804) | 352(328) | 243(470) |

TABLE 2 shows values obtained by respective examinations for respective samples (cables). From the eye pattern test to the single noise crosstalk measurement test, the eye height value is shown out of parenthesis and the jitter value is shown in the parenthesis.

1) Mechanical Characteristic Test (Bending Test)

Figure 4:
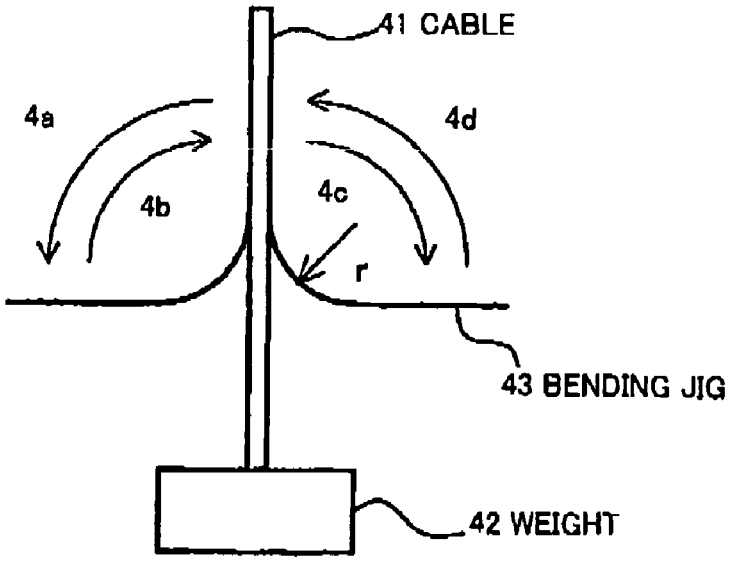
FIG. 4 is a schematic diagram of a flexibility test.

As shown in FIG. 4, a weight 42 with a load 0.05N (50 gf) is dangled at a lower end of a pending cable (also called as "sample") 41, and bending jigs 43 each having a curved form are attached to left and right sides of the cable 41. In this state, bending with a flexion angle of 90° for left and right is added to a point corresponding to an r part of each of the bending jigs 43 of the cable 41 by moving the bending jigs 43. A bending radius r is 2 mm. The bending jigs 43 are moved in order of arrows 4*a*, 4*b*, 4*c*, and 4*d* as 1 cycle (counted as once). As for a test speed, the speed for moving the jigs 43 is determined such that the number of cycles conducted per unit time is 30 times/minute.

As the sample 41, one cable is used for each of the Examples and the Conventional examples. The cycle as described above is repeated and electric conduction of the inner conductor between both ends of the cable is examined for every appropriate time. If the electric conduction exists, the cycle as described above is repeated. If the electric conduction is lost, the number of times at the time of lost is recorded as a bending life time.

2) Mechanical Characteristic Test (Twisting Test)

Figure 5:
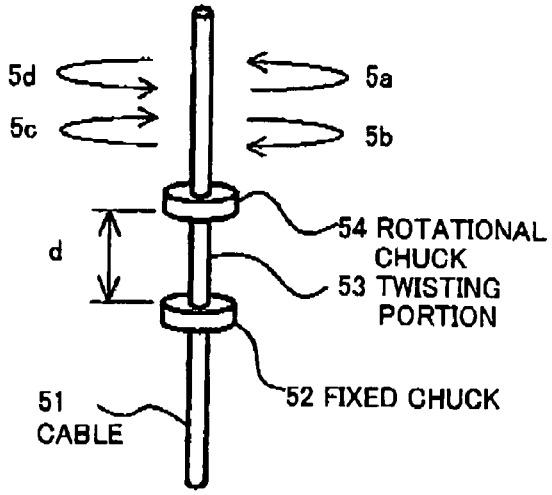
FIG. 5 is a schematic diagram of a twisting test.

As shown in FIG. 5, a point of a cable (sample) 51 is attached to a fixed chuck 52 which does not rotate, and another point of the cable 51, which is distant from an examination object part (testing portion 53) having a length d=20 mm at a location upper than the point to which the fixed chuck 52 is attached, is attached to a rotational chuck 54. A weight (not shown) with a load of 0.05N (50 gf) is dangled at a lower end of the cable 51. In this state, twist of ±180° is applied to the twisting portion 53 by turning the rotational chuck 54. At first, the rotational chuck 54 is rotated by +180°, and turned back to the initial position, then the rotational chuck 54 is rotated by −180°, and turned back to the initial position, so that the rotational chuck 54 is moved in order of the arrows 5*a*, 5*b*, 5*c*, and 5*d* as 1 cycle (counted as once). As for a test speed, the speed for moving the rotational chuck 54 is determined such that the number of cycles conducted per unit time is 60 times/minute.

As the sample 51, one cable is used for each of the Examples and the Conventional examples. The cycle as described above is repeated and electric conduction of the inner conductor between both ends of the cable is examined for every appropriate time. If the electric conduction exists, the cycle as described above is repeated. If the electric conduction is lost, the number of times at that time is recorded as a bending life time.

3) Electric Characteristics Tests (Characteristic Impedance Measurement Test)

Figure 6:
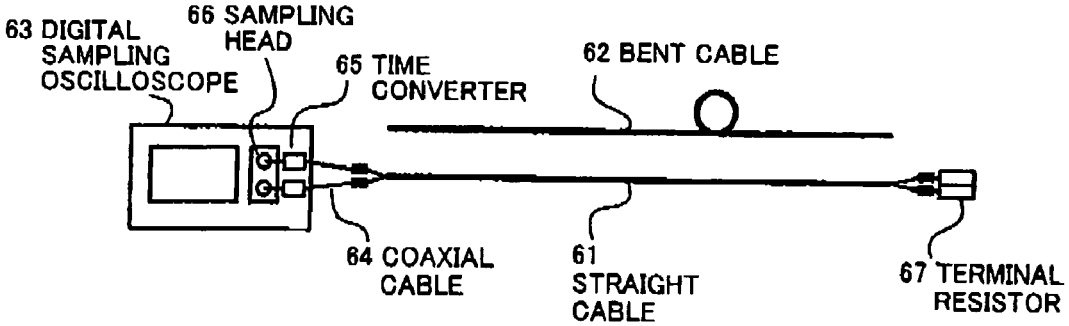
FIG. 6 is a block diagram of a device for a characteristic impedance measurement test.

As shown in FIG. 6, characteristic impedance is measured for a sample (cable) 61 in a straight state and a sample (cable) 62 in a bent (curved) state. As a measuring apparatus, a digital sampling oscilloscope (A86100A manufactured by Agilent Technologies, Inc.) 63 is used. The bending is provided at a point distant by about 20 cm from a transmitting side connector part. The bending is made by bending the sample 62 for 1 loop with a bending radius of 5 mm.

One end of the sample 61 or 62 is provided as a transmitting side. At the transmitting side, two of the inner conductors in the sample are connected to time converters 65 via coaxial cables (COAX) 64 respectively, and the respective time converters 65 are connected to respective sampling heads 66. An opposite end of the sample is provided as a receiving side. At the receiving side, respective terminal resistors 67 of 50Ω are attached to the two of the inner conductors of the sample.

The cables in the Examples and the Conventional examples are used as a sample. The characteristic impedance of the sample in the straight state and the characteristic impedance of the sample in the bent state are measured and recorded, and a difference therebetween is recorded.

4) Electric Characteristic Test (Eye Pattern Measurement Test)

Figure 7:
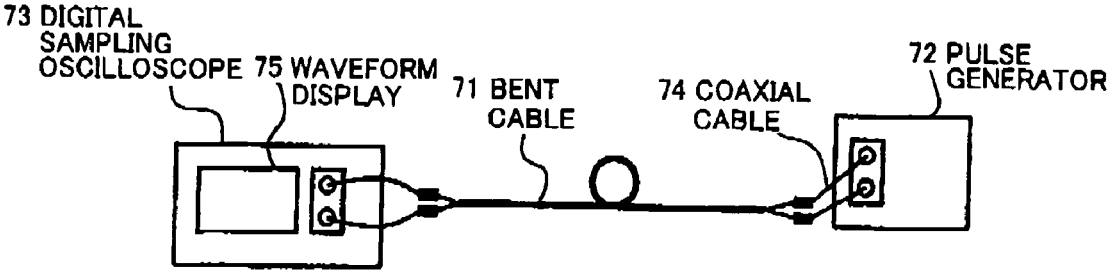
FIG. 7 is a block diagram of a device for an eye pattern measurement test.

As shown in FIG. 7, an eye pattern when a differential signal is input to a sample 71 in a bent state is observed, and an eye height and jitter are measured. A pulse generator 72 and a digital sampling oscilloscope 73 are used as measuring apparatuses. A middle point in a longitudinal direction of the sample 71 is provided with bending. The bending is made by bending the sample 71 for 1 loop with a bending radius of 10 mm.

One end of the sample 71 is provided as a transmitting side. At the transmitting side, two of the inner conductors in the sample 71 are connected to two output terminals of the pulse generator 72 via coaxial cables (COAX) 74 respectively. An opposite end of the sample 71 is provided as a receiving side. At the receiving side, the two of the inner conductors in the sample 71 are connected to sampling heads of the digital sampling oscilloscope 73.

In this state, a differential signal of a bit rate of 1 Mbps to 1000 Mbps is applied to the sample 71. An applied voltage is 1000 mV. The eye pattern displayed on a waveform display 75 of the digital sampling oscilloscope 73 is observed, and an eye height (mV) and a jitter (ps) are measured and recorded.

5) Electric Characteristic Test (Differential Noise Crosstalk Measurement Test)

Figure 8:
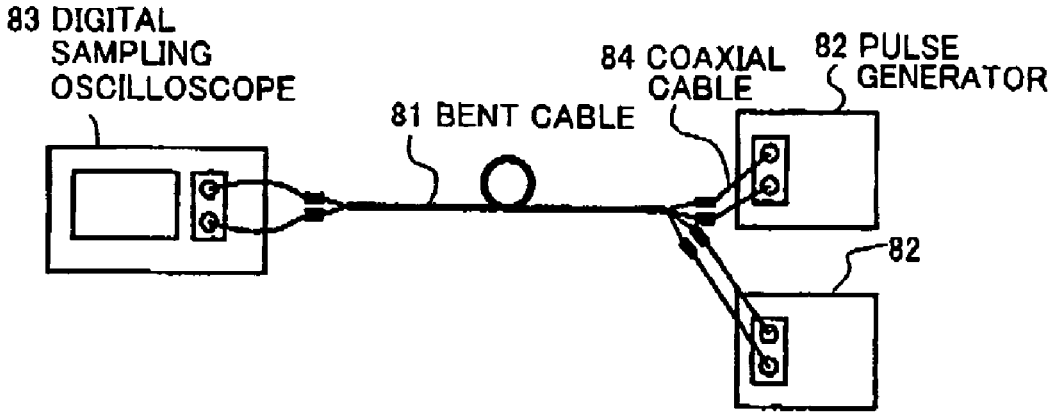
FIG. 8 is a block diagram of a device for a differential noise cross talk measurement test and a single noise cross talk measurement test.
Figure 9:
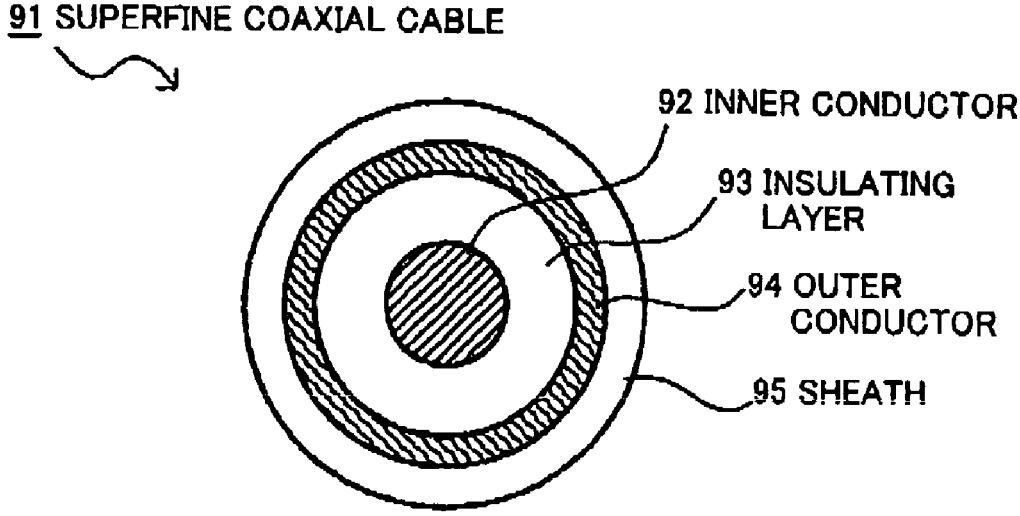
FIG.9 PRIOR ART
FIG. 9 is a cross-sectional view of a conventional superfine coaxial cable.
Figure 10:
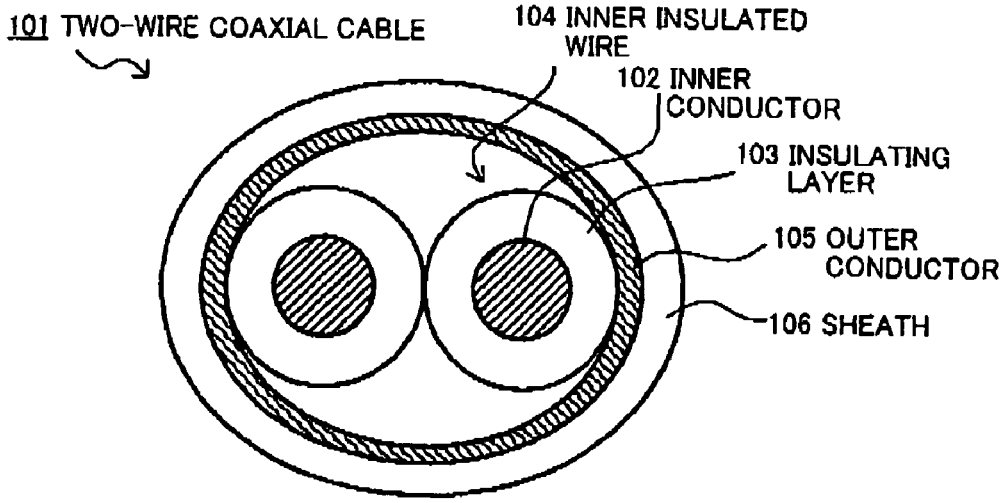
FIG.10 PRIOR ART
FIG. 10 is a cross-sectional view of a conventional two-wire coaxial cable.

As shown in FIG. 8, crosstalk is measured for a sample (cable) 81 in a bent state to which a differential signal and a noise are input. As the measuring apparatus, two pulse generators 82 and a digital sampling oscilloscope 83 are used. The bending is provided at a point distant by about 20 cm from a transmitting side connector part. A center part in a longitudinal direction of the sample 81 is provided with bending. The bending is made by bending the sample 81 for 1 loop with a bending radius of 10 mm.

One end of the sample 81 is provided as a transmitting side. At the transmitting side, two (a, b in FIG. 1) of the inner conductors in the sample 81 are connected to two differential output terminals of one of the pulse generators 82 via coaxial cables (COAX) 84 respectively. Another two (c, d in FIG. 1) of the inner conductors in the sample 81 are connected to two differential output terminals of another of the pulse generators 82 via coaxial cables (COAX) 84 respectively. An opposite end of the sample 81 is provided as a receiving side. At the receiving side, the inner conductors a, b in the sample 81 are connected to sampling heads of the digital sampling oscilloscope 83.

In this state, a differential signal of a bit rate of 1 Mbps to 1000 Mbps and an applied voltage of 1000 mV is applied to the inner conductors a, b, and similar differential signal (used as a noise) is applied to the inner conductors c, d, simultaneously. At this time, the eye pattern displayed on a waveform display 85 of the digital sampling oscilloscope 83 is observed, and the eye height (mV) and jitter (ps) are measured and recorded.

6) Electric Characteristic Test (Single Noise Crosstalk Measurement Test)

In the structure shown in FIG. 8, the crosstalk is measured by changing the kind of the noise. In other words, the differential signal of a bit rate of 1 Mbps to 1000 Mbps and an applied voltage of 1000 mV is applied to the inner conductors a, b, and a single signal of a bit rate of 1 Mbps to 1000 Mbps and an applied voltage of 1000 mV is applied as a noise to the inner conductors c, d, simultaneously. At this time, the eye pattern displayed on the waveform display 85 of the digital sampling oscilloscope 83 is observed, and the eye height (mV) and jitter (ps) are measured and recorded.

With referring to TABLE 2, the mechanical characteristics and the electric characteristics are evaluated.

As shown in TABLE 1, a size (a cross section) of the inner conductor is same in the Example #1 and the Conventional example #1, and in the Example #2 and the Conventional example #2. However, it is found that the bending life time is longer in the Examples #1, #2 than the Conventional examples #1, #2 when the bending characteristics are compared in TABLE 2. In other words, the cable according to the present invention is excellent in the flexibility.

Similarly, it is found that the twisting life time is longer in the Examples #1, #2 than the Conventional examples #1, #2 when the twisting characteristics are compared with each other. In other words, the cable according to the present invention is excellent in the twisting resistance characteristics.

As for the characteristic impedance, when the Example and the Conventional Example in which the size of the inner conductor 2 is same are compared with each other, a difference (amount of the change by bending; referred as "Difference" in the TABLE 2) between the sample in the straight state ("Straight" in the TABLE 2) and the sample in the bent state with the bending radius of 10 mm ("Bent" in the TABLE 2) is smaller in the Examples #1, #2. In other words, the characteristic impedance of the cable according to the present invention is stable with respect to the bending.

In the eye pattern in the bent state at the bending radius of 10 mm, it is found that the eye height is large and the jitter is small in the Examples #1, #2 compared with the Conventional examples #1, #2 at 50 Mbps to 1000 Mbps. In other words, the eye pattern characteristic is good in the cable according to the present invention.

the additives added to the fluorine resin of the skin layer 5 are varied, were manufactured under conditions shown in TABLE 3. The samples prepared under the manufacturing conditions according to the present invention are referred as Examples #3 to #8, and the samples not prepared under the manufacturing conditions according to the present invention are referred as Comparative examples #1 to #11. The sample prepared under the manufacturing conditions of the conventional structure is referred as the Conventional example #3.

TABLE 3

| | Manufacturing conditions | | | | Terminal Workability Evaluation | | | |
|---|---|---|---|---|---|---|---|---|
| | Skin layer thickness (μm) | Skin Layer color | Insulating layer Thickness (μm) | Kind and amount of additive (wt %) | Simultaneous Cutting of Outer conductor and Skin layer | Insulation and withstand voltage | Skin layer Molding | Discrimination |
| Example #3 | 20 | Yellow | 30 | $TiO_2$: 0.42<br>Ni: 0.27 | ○ | ○ | ○ | ○ |
| Example #4 | 20 | Yellow | 30 | $TiO_2$: 0.52<br>Ni: 0.85 | ○ | ○ | ○ | ○ |
| Example #5 | 20 | Yellow | 30 | $TiO_2$: 1.00<br>Ni: 0.5 | ○ | ○ | ○ | ○ |
| Example #6 | 20 | Gray | 30 | C: 0.09<br>$TiO_2$: 0.33 | ○ | ○ | ○ | ○ |
| Example #7 | 20 | Gray | 30 | C: 0.46<br>$TiO_2$: 1.62 | ○ | ○ | ○ | ○ |
| Example #8 | 20 | Gray | 30 | C: 0.2<br>$TiO_2$: 1.00 | ○ | ○ | ○ | ○ |
| Comparative Example #1 | 20 | Yellow | 30 | $TiO_2$: 1.60<br>Ni: 0.3 | ○ | ○ | X | ○ |
| Comparative Example #2 | 20 | Yellow | 30 | $TiO_2$: 0.30<br>Ni: 0.30 | X | ○ | ○ | ○ |
| Comparative Example #3 | 20 | Yellow | 30 | $TiO_2$: 1.60<br>Ni: 0.90 | ○ | ○ | X | ○ |
| Comparative Example #4 | 20 | Yellow | 30 | $TiO_2$: 1.60<br>Ni: 0.25 | ○ | X | X | ○ |
| Comparative Example #5 | 20 | Gray | 30 | C: 0.08<br>$TiO_2$: 0.4 | ○ | X | ○ | ○ |
| Comparative Example #6 | 20 | Gray | 30 | C: 0.50<br>$TiO_2$: 0.4 | ○ | ○ | X | ○ |
| Comparative Example #7 | 20 | Gray | 30 | $TiO_2$: 1.70<br>C: 0.10 | ○ | ○ | X | ○ |
| Comparative Example #8 | 20 | Gray | 30 | $TiO_2$: 0.3<br>C: 0.10 | X | ○ | ○ | ○ |
| Comparative Example #9 | 20 | White | 30 | $TiO_2$: 0.05 | X | X | ○ | ○ |
| Comparative Example #10 | 20 | Black | 30 | C: 0.025 | X | X | ○ | ○ |
| Comparative Example #11 | 20 | Black | 30 | C: 0.14 | X | ○ | ○ | ○ |
| Conventional Example #3 | — | — | 40 | * | — | ○ | — | Impossible |

* Additive to the insulating layer C: 0.06 wt %

In the differential noise crosstalk in the bent state at the bending radius of 10 mm, it is found that the eye height is large and the jitter is small in the Examples #1, #2 compared with the Conventional examples #1, #2 at 50 Mbps to 1000 Mbps. In other words, the differential noise crosstalk characteristic is good in the cable according to the present invention.

In the single noise crosstalk in the bent state at the bending radius of 10 mm, it is found that the eye height is large and the jitter is small in the Examples #1, #2 compared with the Conventional examples #1 #2 at 50 Mbps to 1000 Mbps. In other words, the single noise crosstalk characteristic is good in the cable according to the present invention.

Next, for evaluating the terminal workability, samples having similar structure to the signal transmission cable 1 in the first preferred embodiment according to the present invention shown in FIG. 1, in which manufacturing conditions such as As shown in TABLE 3, the Examples #3 to #5 satisfy the manufacturing conditions, in that the additives are titanium oxide ($TiO_2$) of 0.42 wt % to 1.52 wt %, and nickel (Ni) of 0.27 wt % to 0.85 wt %, and the color of the skin layer 5 is yellow.

The Examples #6 to #8 satisfy the manufacturing conditions, in that the additives are carbon (C) of 0.09 wt % to 0.46 wt %, and titanium oxide ($TiO_2$) of 0.33 wt % to 1.62 wt %, and the color of the skin layer 5 is gray.

In the Comparative examples #1 to #4, the titanium oxide ($TiO_2$) and nickel (Ni) are used and the color of the skin layer 5 is yellow. However, the doping amount of the additive does not satisfy the manufacturing conditions.

In the Comparative examples #5 to #8, the carbon (C) and the titanium oxide ($TiO_2$) are used and the color of the skin layer 5 is gray. However, the doping amount of the additive does not satisfy the manufacturing conditions.

In the Comparative examples #9 to #11, only a single kind of the additive is added and colors thereof are different.

In addition, although it is not shown in the TABLE 3, the colors of the respective insulating layers 3 of the four inner insulated wires 4 are different from each other, namely, black, yellow, red, and blue, that are unified in all of the Examples and Comparative examples.

The terminal workability test is conducted as follows.

Ten samples are prepared for each of the Examples, Comparative examples, and Conventional example. The ten samples are arranged with a pitch of 1.5 mm, and the sheath layer 7 is cut at a point distant by 3 mm from the terminal by means of the $CO_2$ laser. The cut sheath layer 7 is mechanically exfoliated, and a part of the outer conductor 6 is exposed for 3 mm from the terminal. Thereafter, the outer conductor 6 and the skin layer 5 are cut by the YAG laser.

For evaluating the terminal workability, the simultaneous cutting is firstly evaluated. The simultaneous cutting is evaluated as good in the case that no cutting residual of the skin layer 5 is found when the cut outer conductor 6 and the skin layer 5 are mechanically cut at the same time, and that the outer conductor 6 and the skin layer 5 are completely exfoliated at the same time. If not, the simultaneous cutting is evaluated as failure.

Secondly, the insulation and the withstand voltage are evaluated. The insulation and the withstand voltage are evaluated as good in the case that the insulation resistance of the insulating layer 3 of the inner insulated wires 4 at the point cut by the YAG laser is not less than $2\times10^3$ MΩ/km and that the insulating layer 3 can withstand an application test voltage of A.C. 300V for 1 minute. If not, the insulation and the withstand voltage are evaluated as failure. Measurement of the insulation resistance and the application of the voltage are conducted between the inner conductor 2 and the insulating layer 3.

Thirdly, the molding is evaluated. The molding is evaluated as good when the skin layer 5 can be molded such that the thickness of the skin layer 5 is uniform (tolerance of ±15%). If not, the molding is evaluated as failure.

Fourthly, the discrimination is evaluated. The discrimination is evaluated as good in the case that the four inner insulated wires 4 are easily discriminated from each other by visual inspection. If not, the discrimination is evaluated as failure (impossible).

With referring to TABLE 3, the evaluation results of the terminal workability will be explained.

In the Comparative example #1, the titanium oxide and the nickel are added to the fluorine resin which is the main material of the skin layer 5. The content of the titanium oxide is 1.60 wt % that is more than the manufacturing conditions according to the present invention (an upper limit is 1.52 wt %). Therefore, when the skin layer 5 is formed, the material is rigid and the fluidity is bad, so that the thickness of the skin layer 5 after molding is not uniform. As a result, the molding is evaluated as failure.

In the Comparative example #2, the titanium oxide and the nickel are added to the fluorine resin which is the main material of the skin layer 5. The content of the titanium oxide is 0.30 wt % that is less than the manufacturing conditions according to the present invention (a lower limit is 0.42 wt %). Therefore, an effect of melting the insulator by reflection of the laser beam in the skin layer 5 was insufficient. As a result, the outer conductor 6 and the skin layer 5 could not be cut at the same time.

In the Comparative example #3, the titanium oxide and the nickel are added to the fluorine resin which is the main material of the skin layer 5. The content of the titanium oxide is 1.60 wt % and the content of the nickel is 0.90 wt % that are more than the manufacturing conditions according to the present invention (the upper limit of the titanium oxide is 1.52 wt % and an upper limit of the nickel is 0.85 wt %). Therefore, when the skin layer 5 is formed, the material is rigid and the fluidity is bad, so that the thickness of the skin layer 5 after molding is not uniform. As a result, the molding is evaluated as failure.

In the Comparative example #4, the titanium oxide and the nickel are added to the fluorine resin which is the main material of the skin layer 5. The content of the titanium oxide is 1.60 wt % that is more than the manufacturing conditions according to the present invention (the upper limit is 1.52 wt %). Therefore, the effect of melting the insulator by reflection of the laser beam in the skin layer 5 was sufficient. As a result, the outer conductor 6 and the skin layer 5 could be cut at the same time. However, since the content of the nickel is 0.25 wt % that is less than the manufacturing conditions according to the present invention (a lower limit is 0.27 wt %), an absorbing amount of the laser beam by the nickel is small. As a result, a transmission rate of the laser beam in the skin layer 5 is increased, so that the insulating layer 3 of the inner insulated wire 4 was damaged due to the melting by the laser beam. Therefore, the insulation and the withstand voltage are evaluated as failure.

In the Comparative example #5, the carbon black and the titanium oxide are added to the fluorine resin which is the main material of the skin layer 5. The content of the carbon black is 0.08 wt % that is less than the manufacturing conditions according to the present invention (a lower limit is 0.09 wt %). Therefore, since an effect of absorbing the laser beam by the carbon black cannot be expected, the transmission rate of the laser beam in the skin layer 5 is increased, so that the insulating layer 3 was damaged due to the melting by the laser beam.

In the Comparative example #6, the carbon black and the titanium oxide are added to the fluorine resin which is the main material of the skin layer 5. The content of the carbon black is 0.50 wt % that is more than the manufacturing conditions according to the present invention (the upper limit is 0.46 wt %). Therefore, when the skin layer 5 is formed, the material is rigid and the fluidity is bad, so that the thickness of the skin layer 5 after molding is not uniform. As a result, the molding is evaluated as failure.

In the Comparative example #7, the carbon black and the titanium oxide are added to the fluorine resin which is the main material of the skin layer 5. The content of the titanium oxide is 1.70 wt % that is more than the manufacturing conditions according to the present invention (the upper limit is 1.62 wt %). Therefore, when the skin layer 5 is formed, the material is rigid and the fluidity is bad, so that the thickness of the skin layer 5 after molding is not uniform. As a result, the molding is evaluated as failure.

In the Comparative example #8, the carbon black and the titanium oxide are added to the fluorine resin which is the main material of the skin layer 5. The content of the titanium oxide is 0.3 wt % that is less than the manufacturing conditions according to the present invention (the lower limit is 0.33 wt %). Therefore, since the heat absorption in the skin layer 5 is small when the laser beam is reflected by the titanium oxide, the skin layer 5 is hardly molten. As a result, the outer conductor 6 and the skin layer 5 are hardly exfoliated at the same time, so that the simultaneous cutting is evaluated as failure.

In the Comparative example #9, only the titanium oxide is added to the fluorine resin which is the main material of the skin layer 5. In addition, the content of the titanium oxide is small. Therefore, since the effect of melting the insulating material by the reflection of the laser beam in the skin layer 5 was insufficient. As a result, the outer conductor 6 and the skin layer 5 could not be cut at the same time, so that the simultaneous cutting is evaluated as failure. In addition, the transmission rate of the laser beam in the skin layer 5 is extremely high, so that the insulating layer 3 of the inner insulated wire 4 was damaged due to the melting by the laser beam. Therefore, the insulation and the withstand voltage are evaluated as failure.

In the Comparative example #10, only the carbon black is added to the fluorine resin which is the main material of the skin layer 5. Further, the content of the carbon black is small. Therefore, since the heat absorption by the carbon black in the skin layer 5 is small, the skin layer 5 is hardly molten. As a result, the outer conductor 6 and the skin layer 5 are hardly exfoliated at the same time, so that the simultaneous cutting is evaluated as failure. In addition, since the content of the carbon black is small, the transmission rate of the laser beam in the skin layer 5 is extremely high, so that the insulating layer 3 of the inner insulated wire 4 was damaged due to the melting by the laser beam. Therefore, the insulation and the withstand voltage are evaluated as failure.

In the Comparative example #11, the heat absorption by the carbon black in the skin layer 5 is insufficient for melting the skin layer 5. As a result, the outer conductor 6 and the skin layer 5 are hardly exfoliated at the same time, so that the simultaneous cutting is evaluated as failure.

In the Conventional example #3, since no skin layer is provided, the colors of all of the four inner insulated wires 114 are black. Therefore, it is impossible to discriminate the inner insulated wires 114 from each other by visual color inspection.

It is concluded that the Examples #3 to #8 are good in the simultaneous cutting, the insulation and the withstand voltage, the molding, the discrimination, and the terminal workability, compared with the Comparative examples #1 to #11 and the Conventional example #3.

According to the evaluation results of the Examples, it is concluded as follows. Since the skin layer 5 is provided, the present invention is excellent in the mechanical characteristics and the electric characteristics. Further, the present invention is excellent in the terminal workability, since the kind and amount of the additives to be added to the fluorine resin of the skin layer 5 are appropriately determined.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A signal transmission cable comprising:

a plurality of inner insulated wires stranded with each other, each of the inner insulated wires comprising:

an inner conductor;

an insulating layer mainly composed of a fluorine resin provided at an outer periphery of the inner conductor;

a skin layer mainly composed of a fluorine resin and doped with a titanium oxide and a carbon black as color pigment and provided at an outer periphery of the stranded inner insulated wires;

an outer conductor provided at an outer periphery of the skin layer; and a sheath layer comprising an insulator and provided at an outer periphery of the outer conductor, wherein the skin layer comprises 0.09 wt % to 0.46 wt % of the carbon black and 0.33 wt % to 1.62 wt % of the titanium oxide.

2. The signal transmission cable, according to claim 1, wherein respective insulating layers of the inner insulated wires comprise insulating materials having colors different from each other.

3. The signal transmission cable, according to claim 1, wherein a thickness of the insulating layer is less than 40 μm.

4. The signal transmission cable, according to claim 1, wherein the skin layer is formed by extrusion molding or wrapping.

5. The signal transmission cable, according to claim 1, wherein the outer conductor comprises a silver plated hard-drawn copper wire, a tin plated hard-drawn copper wire, a wound silver plated copper alloy wire, a wound tin plated copper alloy wire, or a braided silver plating copper alloy wire.

6. A multi-wire cable comprising a plurality of the signal transmission cables according to claim 1, wherein the signal transmission cables are flatly arranged.

7. A multi-wire cable comprising a plurality of the signal transmission cables according to claim 1, wherein the signal transmission cables are stranded with each other.

8. A signal transmission cable comprising:

a plurality of inner insulated wires stranded with each other, each of the inner insulated wires comprising:

an inner conductor;

an insulating layer mainly composed of a fluorine resin provided at an outer periphery of the inner conductor;

a skin layer mainly composed of a fluorine resin and doped with a titanium oxide and a nickel as color pigment and provided at an outer periphery of the stranded inner insulated wires;

an outer conductor provided at an outer periphery of the skin layer; and a sheath layer comprising an insulator and provided at an outer periphery of the outer conductor, wherein the skin layer comprises 0.42 wt % to 1.52 wt % of the titanium oxide and 0.27 wt % to 0.85 wt % of the nickel.

9. The signal transmission cable, according to claim 8, wherein respective insulating layers of the inner insulated wires comprise insulating materials having colors different from each other.

10. The signal transmission cable, according to claim 8, wherein a thickness of the insulating layer is less than 40 μm.

11. The signal transmission cable, according to claim 8, wherein the skin layer is formed by extrusion molding or wrapping.

12. The signal transmission cable, according to claim 8, wherein the outer conductor comprises a silver plated hard-drawn copper wire, a tin plated hard-drawn copper wire, a wound silver plated copper alloy wire, a wound tin plated copper alloy wire, or a braided silver plating copper alloy wire.

13. A multi-wire cable comprising a plurality of the signal transmission cables according to claim 8, wherein the signal transmission cables are flatly arranged.

14. A multi-wire cable comprising a plurality of the signal transmission cables according to claim 8, wherein the signal transmission cables are stranded with each other.

* * * * *

UNITED STATES PATENT AND TRADEMARK OFFICE

CERTIFICATE OF CORRECTION

PATENT NO. : 7,622,679 B2
APPLICATION NO. : 12/213107
DATED : November 24, 2009
INVENTOR(S) : Detian Huang et al.

It is certified that error appears in the above-identified patent and that said Letters Patent is hereby corrected as shown below:

Title Page
INID Code (73) change First Assignee "Hitachi Global, Ltd., Tokyo (JP)" to "Hitachi Cable, Ltd., Tokyo (JP)"

Signed and Sealed this

Twenty-third Day of February, 2010

David J. Kappos

David J. Kappos
*Director of the United States Patent and Trademark Office*